US006305785B1

(12) United States Patent
Hosaka et al.

(10) Patent No.: US 6,305,785 B1
(45) Date of Patent: Oct. 23, 2001

(54) HEAD HOLDER, HEAD ASSEMBLY, HEAD CARTRIDGE, INK JET RECORDER, AND METHOD FOR MANUFACTURING HEAD ASSEMBLY

(75) Inventors: Ken Hosaka; Masanori Takenouchi, both of Yokohama; Wataru Takahashi; Yoshiaki Kurihara, both of Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/427,616

(22) Filed: Oct. 27, 1999

(30) Foreign Application Priority Data

Oct. 27, 1998 (JP) ..... 10-306140
Oct. 30, 1998 (JP) ..... 10-310800

(51) Int. Cl.[7] ..... B41J 2/14
(52) U.S. Cl. ..... 347/49; 347/50
(58) Field of Search ..... 347/49, 86, 87, 347/50

(56) References Cited

U.S. PATENT DOCUMENTS 5,583,549 * 12/1996 Ujita et al. ..... 347/86
5,646,665 * 7/1997 Swanson et al. ..... 347/87
5,784,082 * 7/1998 Shinmachi et al. ..... 347/49
5,880,754 * 3/1999 Niikura et al. ..... 347/18
6,022,091 * 2/2000 Uchikata et al. ..... 347/8
6,069,644 * 5/2000 Tanioka et al. ..... 347/238

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

A head holder including an ink jet head for discharging ink and a flexible cable on which a contact portion to which an electric signal for discharging ink from the ink jet head is transferred is formed and which is joined to the ink jet head, wherein an opening through which the flexible cable passes is formed in the head holder and a portion of the flexible cable on which the contact portion is formed is exposed to the outside of the head holder from the opening of the head holder.

35 Claims, 11 Drawing Sheets

HEAD HOLDER, HEAD ASSEMBLY, HEAD CARTRIDGE, INK JET RECORDER, AND METHOD FOR MANUFACTURING HEAD ASSEMBLY

BACKGROUND OF THE INVENTION

1. Field of the Invention

The present invention relates to an ink jet head for recording data in a recording medium by discharging a liquid (also referred to as ink) to the recording medium, a head holder to which a flexible cable joined to the ink jet head is set, a head assembly configured by setting the ink jet head and the flexible cable to the head holder, a head cartridge configured by removably setting a tank holder for mounting an ink tank to the head assembly, an ink jet recorder mounting the head cartridge, and a method for manufacturing the head assembly.

The present invention is an invention which can be applied to an apparatus such as a printer, a copying machine, a facsimile having a communication system, or a word processor having a printer which record data in a recording medium such as paper, yarn, cloth, leather, metal, plastic, glass, wood, or ceramics and moreover, applied to an industrial recorder configured by complexly combining the present invention with various processors. In this case, "recording" in the present invention represents providing not only a meaningful image such as a character or graphic but also a meaningless image such as a pattern for a recording medium.

2. Related Background Art

A flexible cable serving as a driving wiring for an ink jet head has been frequently used for ink jet recorders so far. The flexible cable is flexible for deformation of the shape of the cable and also versatile for bending of the cable, it is effective as wiring means extending from the ink jet head to the connector section of the ink jet recorder. In the case of an ink jet recorder, a head assembly is configured by setting an ink jet head and a flexible cable connected to the ink jet head to a head holder. A contact portion to which an electric signal for discharging ink from the ink jet head is formed on the flexible cable. When setting a head assembly to, for example, the carriage of the ink jet recorder, the contact portion of the flexible cable of the head assembly is brought into contact with and electrically connected with the contact portion of the ink jet recorder.

For example, only a flexible cable may be set to a head holder to which an ink jet head will be set. In this case, the flexible cable has versatility. However, when setting an assembly configured of the ink jet head and the flexible cable to the head holder, the flexible cable is set to the head holder by winding the flexible cable on the outside face of the head holder. In this case, the entire flexible cable is exposed to the outside of the head holder.

However, to set an assembly configured of a flexible cable and an ink jet head to a head holder in accordance with the conventional manner, if a head assembly is configured so that the entire flexible cable is exposed to the outside of the head holder as described above, problems occur that the number of restrictions for setting the flexible cable increases and the fabrication cost increases.

Moreover, a head assembly having an ink jet head and a flexible cable is generally removably mounted on an ink jet recorder. For the head assembly removable from the ink jet recorder, a flexible cable on which a contact portion serving as an electric contact with the ink jet recorder is formed is important.

When a head assembly having an ink jet head is removably set to an ink jet recorder, a flexible cable exposed to the outside of a head holder may receive an impact when the head assembly is set, removed, or operated and be disconnected or damaged. Thus, when the flexible cable is damaged, recording may be interrupted and it may be impossible to use the head assembly.

TAB (Tape Automated Bonding) and FPC (Flexible Printed Circuit) are used for the above flexible cable or a technical configuration similar to the flexible cable. In the case of a configuration for using the TAB and FPC for a recorder, by fixing them to an ink jet head and connecting them to a contact portion provided for the carriage of the recorder, a signal and electric energy supplied from the recorder for driving an electrothermal element for generating energy used to discharge ink as droplets are supplied to the electrothermal element. For example, when using the TAB, it is permitted to directly connect the TAB to the pad of a board on which an electrothermal element is formed. When using the FPC, it is permitted to connect the FPC to the pad through a PWB (Printed Wiring Board).

A hot-melt sheet using ethyl vinyl acetate (EVA) or ethylacrylic acid (EAA) as a base polymer has been used so far in order to bond an electric circuit component to a structural member. The hot-melt sheet has advantages that it can be bonded at a relatively low temperature, it is unnecessary to dry the sheet in the bonding step because it does not contain a solvent or water, and the productivity is improved. Moreover, it is possible to easily automate the bonding step and simplify maintenance.

However, urea is frequently added to ink used for an ink jet head in order to prevent the ink from sticking to an ink discharge port. Hydrolysis of EVA or EAA is progressed due to ammonia gas or alkali vapor produced due to decomposition of the urea and thereby, an adhesive strength may be extremely lowered.

Moreover, the number of discharge ports formed on one ink jet head tends to increase more and more for high-speed printing. Therefore, the thickness and width of the copper foil of TAB or FPC tends to increase in order to flow a large current. As a result, unless the rigidity of a flexible wiring board is improved and bonded to a structural member at a higher adhesive strength, the adhesive strength is defeated by the reaction of TAB or FPC and a trouble such as positional shift or separation from the structural board may occur.

Moreover, a package may be exposed to a high temperature of 60° C. when a recorder circulates. Therefore, it is also necessary to consider the adhesive strength at a high temperature. EVA or EAA has a large adhesive strength at 25° C. but a relatively small adhesive strength at a high temperature. As a result, the adhesive strength is defeated by the reaction of TAB, FPC or the like, and a trouble such as positional shift or separation may occur.

SUMMARY OF THE INVENTION

It is one of the objects of the present invention to provide a head holder capable of preventing a flexible cable from damaging when setting, removing, or operating a head assembly, a head assembly and head cartridge using the head holder, an ink jet recorder, and a method of manufacturing head assembly which is capable of manufacturing the head assembly integrated with a flexible cable through a simple process.

It is another object of the present invention to provide a head holder in which decrease of the adhesive strength of a contact portion is mitigated and the reliability is improved even if contacting with the vapor of alkali ink, a head assembly and cartridge using the head holder, an ink jet recorder, and a head-assembly fabrication method capable of manufacturing the head assembly integrated with a flexible cable through a simple process.

It is still another object of the present invention to provide a head holder on which an ink jet head for discharging ink and a contact portion to which an electric signal for discharging ink from the ink jet head is transferred are formed and to which a flexible cable to be joined to the ink jet head is set, wherein an opening for passing the flexible cable is formed on the head holder, an opening through which the flexible cable passes is formed on the head holder, and a portion of the flexible cable where the contact portion is formed is exposed to the outside of the head holder from the opening of the head holder.

In the case of the present invention, it is possible to arrange portions of a flexible cable other than an exposed portion and a joint between the flexible cable and an ink jet head in a head holder to which the ink jet head is set by passing the flexible cable through an opening formed on the head holder and exposing a portion of the flexible cable where a contact portion is formed to the outside of the head holder as the exposed portion when setting the flexible cable to the head holder. Thereby, for example, when setting or removing a head assembly configured by setting an ink jet head and a flexible cable to a head holder to or from the carriage of an ink jet recorder, it is prevented that the flexible cable is damaged due to a hang-up with the flexible cable or an impact applied to the head assembly. Moreover, it is prevented that the flexible cable is damaged due to the heat from the outside of the head assembly. By setting an ink jet head and a flexible cable to the above head holder and thereby constituting a head assembly, it is possible to protect the flexible cable even if the head assembly is set to or removed from the carriage of an ink jet recorder and thereby, provide a head assembly having a high reliability.

Specifically, the opening of the head holder and the exposed portion of the flexible cable are arranged on the same plane on the head holder. In this case, a head assembly configured by setting the ink jet head and the flexible cable to the head holder is mounted on a carriage provided for an ink jet recorder for recording data in a recording medium and it is preferable that the opening and the exposed portion of the flexible cable are arranged on a plane facing the carriage side when the carriage is mounted.

As described above, by arranging the opening of a head holder and the exposed portion of a flexible cable on the same plane on the head holder, it is possible to further protect the flexible cable. For example, if the opening of a head holder and the exposed portion of a flexible cable are arranged on planes different from each other, it is necessary to set a part of the flexible cable to the outside of a corner of the head holder in order to expose the exposed portion of the flexible cable to the outside of the head holder through the opening and set the exposed portion to a plane different from the opening. In this case, an impact applied to the head holder is directly applied to the flexible cable and thereby, wiring in the flexible cable may be disconnected. Therefore, by setting the opening of the head holder and the exposed portion of the flexible cable on the same plane, it is unnecessary to set the flexible cable to the outside of the head holder and it is possible to protect the flexible cable. Moreover, in this case, because the opening of the head holder and the exposed portion of the flexible cable are arranged on the plane of the head holder facing the carriage when the head holder is set to the carriage, the scanning-directional width of the carriage of an ink jet recorder is not increased when two head assemblies are mounted on the ink jet recorder in parallel and thereby, it is possible to downsize the ink jet recorder.

Furthermore, it is preferable that the flexible cable has at least one bent portion correspondingly to the inside shape of the head holder. Thus, because the bent portion is formed on the flexible cable, it is possible to decrease the impact force applied to the joint between the flexible cable and the ink jet head in the case where a finger erroneously contacts the flexible cable or in other cases. In this case, to set the flexible cable having the bent portion to the head holder, it is necessary that the length of the opening is larger than the width of the exposed portion so that the exposed portion of the flexible cable can be inserted into the opening of the head holder from the inside of the head holder.

Moreover, it is preferable that the opening of the head holder is set to an end of the plane of the head holder on which the opening is formed. Thus, because the opening of the head holder is set to an end of the plane on which the opening is formed, it is possible to secure a large area to which the exposed portion of the flexible cable is set on the plane and thereby increase the area of a contact portion. Furthermore, it is possible to increase the strength of the contact portion of the flexible cable and thereby, the reliability of electrical connection between contact portions is improved when bringing the contact portion of the flexible cable into contact with another contact portion.

Furthermore, the exposed portion of the flexible cable is fixed to the head holder and a stepped portion protruded from the plane to which the exposed portion of the head holder is fixed is formed around the exposed portion of the head holder. Thus, when the stepped portion is formed on the head holder, a hang-up to the exposed portion of the flexible cable is prevented and thereby, it is possible to protect the exposed portion.

Moreover, it is preferable that a hole for communicating the inside and outside of the head holder each other is formed at a portion of the head holder nearby the joint between the ink jet head and the flexible cable. Thus, when the hole is formed on the head holder, the heat in the head holder is discharged to the outside of the head holder through the hole and deformation of the flexible cable due to heat or trouble of the joint between the flexible cable and ink jet head due to heat is prevented.

A head assembly fabrication method of the present invention is a method of manufacturing a head assembly configured of an ink jet head for discharging ink, a flexible cable on which a contact portion to which an electric signal for discharging ink from the ink jet head is transferred is formed and which is joined to the ink jet head, and a head holder in which an opening through which the flexible cable passes is formed and to which the flexible cable and the ink jet head are set so that the portion of the flexible cable on which the contact cable is formed is exposed from the opening, and comprises the steps of preparing the flexible cable, ink jet head, and head holder; joining the flexible cable with the ink jet head; and passing the flexible cable through the opening of the head holder so that the exposed portion of the flexible cable is exposed to the outside of the head holder and setting the ink jet head and portions of the flexible cable other than the exposed portion in the head holder; and fixing the ink jet head and the exposed portion of the flexible cable to the head holder.

In the case of the above fabrication method, it is preferable to execute the step of forming a bent portion on the flexible cable by bending the flexible cable in accordance with the inside shape of the head holder before the step of joining the flexible cable with the ink jet head.

As described above, in the case of the above head-assembly fabrication method of the present invention, it is possible to easily fabricate a head assembly capable of improving the reliability and achieving a long service life by protecting the flexible cable.

Therefore, the present invention has an advantage that a head assembly and a head cartridge respectively having a high reliability and a long service life can be configured by using a head holder to which an ink jet head is set because an opening is formed on the head holder, only a portion of a flexible cable on which a contact portion is formed on the opening through the flexible cable is exposed to the outside of the head holder and thereby, portions of the flexible cable excluding the portion on which the contact portion is formed and the joint between the flexible cable and the ink jet head are protected from impact and heat. Moreover, a head-assembly fabrication method of the present invention has an advantage that a head assembly capable of achieving improvement of the reliability and lengthening of the service life can be easily fabricated.

In the case of the present invention, by using polyester and/or polyolefin as the base polymer of a hot-melt sheet for bonding a flexible wiring board to a structural member, it is possible to prevent the adhesive strength from deteriorating even if a bonding portion contacts the vapor of alkaline ink. Moreover, it is possible to prevent positional shift or separation due deterioration of the adhesive strength and provide an ink jet head cartridge having a high reliability.

DETAILED DESCRIPTION OF THE PREFERRED EMBODIMENTS

Then, the preferred embodiments of the present invention are described below by referring to the accompanying drawings.

Figure 1:
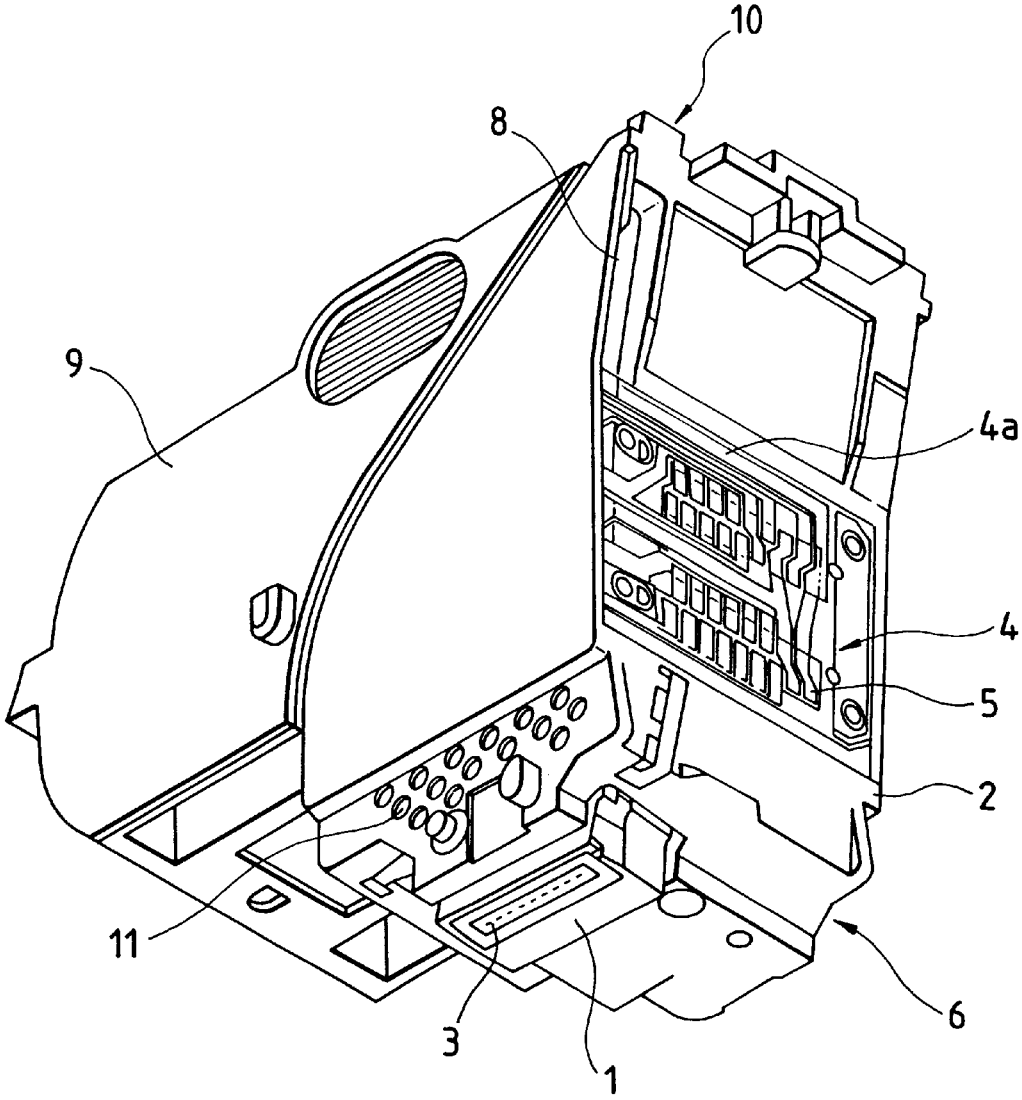
FIG. 1 is a perspective view showing the head cartridge of an embodiment of the present invention.
Figure 2:
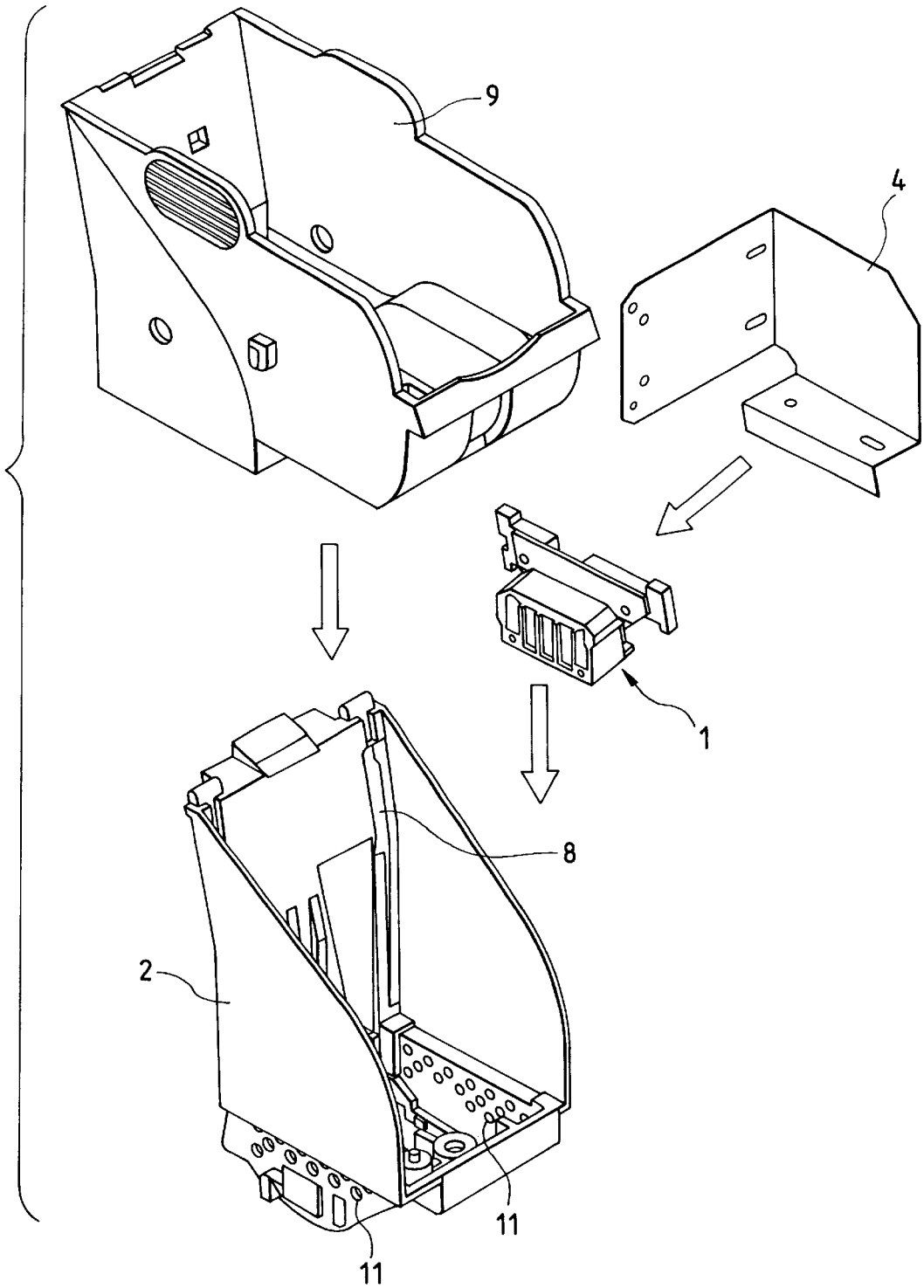
FIG. 2 is a perspective view showing a disassembled state of the head cartridge shown in FIG. 1.

FIG. 1 is a perspective view showing the head cartridge of an embodiment of the present invention. FIG. 2 is a perspective view showing a disassembled state of the head cartridge shown in FIG. 1.

As shown in FIGS. 1 and 2, the head cartridge 10 of this embodiment is configured of an ink jet head 1 on which an ink discharge port 3 for discharging ink is formed, a head holder 2 to which the ink jet head 1 is set, a flexible cable 4 joined with the ink jet head 1 and set to the head holder 2, and a tank holder 9 removable set to the head holder 2 and serving as a vessel holder for mounting an ink tank. An electrothermal element or piezoelectric element for generating the energy used to discharge ink from the ink discharge port 3 is formed on the ink jet head 1.

An end of the flexible cable 4 is joined to the ink jet head 1 and the joint between the flexible cable 4 and ink jet head 1 is set in the head holder 2. A plurality of contact pads 5 electrically connected with a contact pad provided for an ink jet recorder is formed on one plane of the other end of the flexible cable 4. When the head cartridge 10 is mounted on a carriage provided for the ink jet recorder, the contact pad 5 contacts a contact portion (not illustrated) of the ink jet recorder. Thereby, it is possible to transfer a signal or the like for discharging ink from the ink discharge port 3 to the ink jet head 1 through the contact pad 5.

An opening 8 through which the flexible cable 4 passes is formed on a plane of the head holder 2 different from the plane on which the ink jet head 1 is set. The portion of the flexible cable 4 on which the contact pads 5 are formed is extended from the inside of the head holder 2 to the outside of the head holder 2 through the opening 8 and serves as an exposed portion 4*a* exposed to the outside of the head holder 2.

If the whole of the flexible cable 4 is exposed to the outside of the head holder 4, the flexible cable 4 may be more easily broken due to an external factor such as heat, impact from the outside of the head holder 4, or hang-up with the ink jet recorder. Therefore, in the case of this embodiment, only the portion on which the contact pad 5 of the flexible cable 4 to be electrically connected with the ink jet recorder is exposed to the outer surface of the head holder 2 as the exposed portion 4*a* and portions of the flexible cable 4 unnecessary for contact, that is, portions other than the exposed portion 4*a* and the joint between the flexible 4 and the ink jet head 1 are arranged in the head holder 4. Thereby, it is possible to prevent a user from directly contacting the flexible cable 4 or hang-up with the flexible cable 4 from occurring and protect the flexible cable 4. As a result, the head assembly 6 and head cartridge 10 respectively having a high reliability and a long service life are obtained. The length of the opening 8 through which the flexible cable 4 passes is larger than the width of the exposed portion 4*a* so that the exposed portion 4*a* of the flexible cable 4 having a bent portion can be inserted into the opening 8 from the inside of the head holder 2 when setting the flexible cable 4 previously bent and thereby having the bent portion to the head holder 2 as described later.

Figure 3:
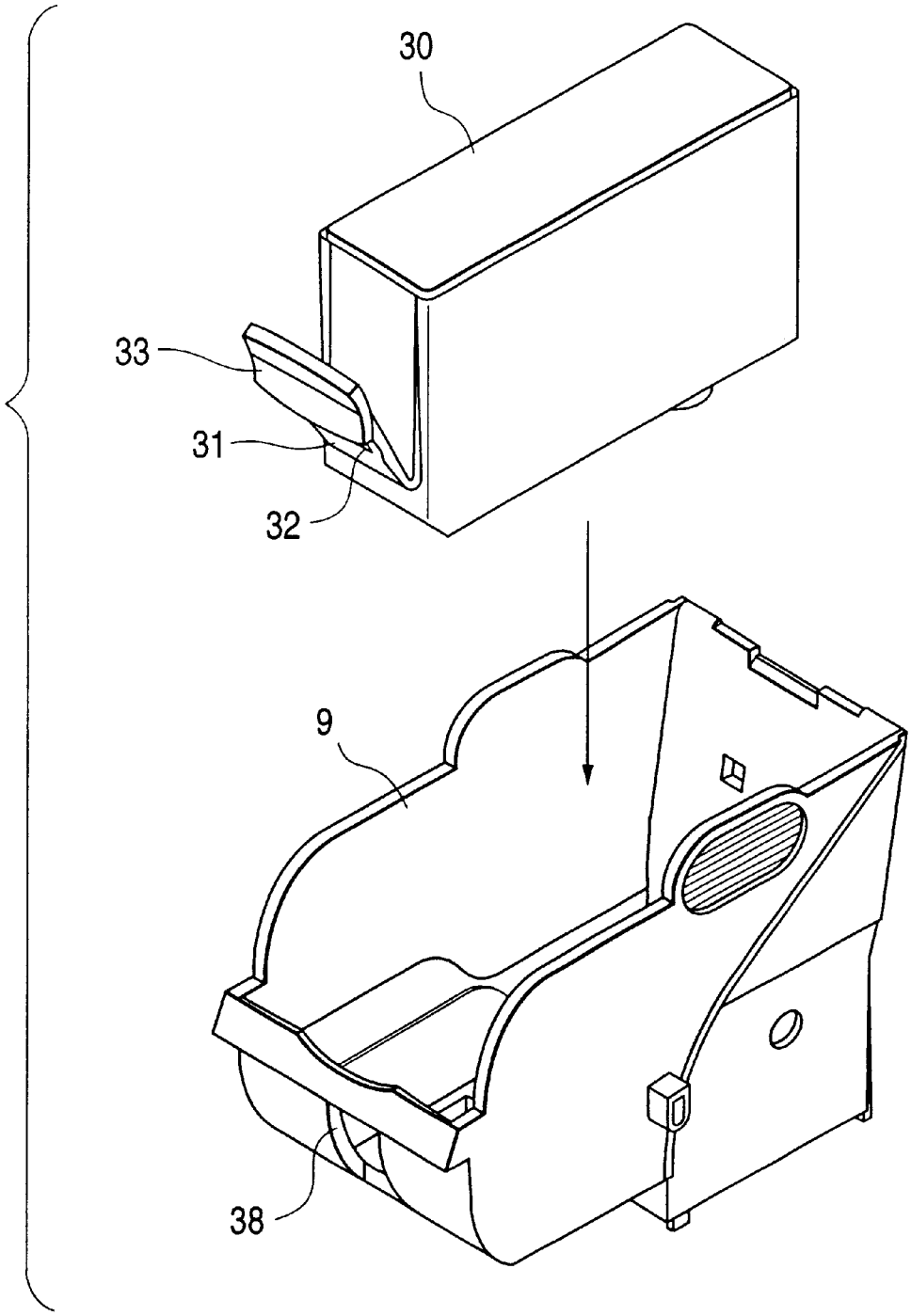
FIG. 3 is a perspective view for explaining an ink tank to be mounted on the tank holder shown in FIGS. 1 and 2.

FIG. 3 is a perspective view for explaining an ink tank to be mounted on the tank holder 9 shown in FIGS. 1 and 2. As shown in FIG. 3, an interchangeable ink tank 30 serving as a liquid storing vessel is removably mounted on the tank holder 9. A movable lever 31 used to set or remove the ink tank 30 to or from the tank holder 9 is formed on the side face of the ink tank 30. The front end of the movable lever 31 serves as a knob 33 and a pawl 32 engaged with an engagement hole 38 formed on the tank holder 9 is formed on the movable level 31. It is permitted to constitute the tank holder 9 and the head holder 2 so as to be united into one body or so as to be separable from each other like the case of this embodiment.

In the case of the head cartridge 10 of this embodiment, the opening 8 and the contact pad 5 of the flexible cable 4 are arranged on the back of the head holder 2, that is, the plane facing the carriage side when mounting the head cartridge 10 on the carriage. The reason is described below.

In recent years, not only high image quality but also high speed have been requested for an ink jet recorder. The ink jet recorder of this embodiment mounts two head cartridges 10 by arranging them in parallel and one of the two head cartridges 10 mounts one ink tank 30 as shown in FIG. 3. Black ink is stored in the ink tank 30 and the one head cartridge 10 discharges black ink. Moreover, the other head cartridge (not illustrated) discharges three color inks of yellow, magenta, and cyanogen. Three ink tanks for storing three color inks of yellow, magenta, and cyanogen are removably mounted on the tank holder of the not-illustrated head cartridge. The color cartridge is configured similarly to the head cartridge shown in FIG. 3, in which three independent tanks are removable by dividing the inside of the head cartridge into three parts.

Thus, a very high throughput compared to the conventional case is achieved by mounting two head cartridges on an ink jet recorder. Moreover, recording corresponding to a photo-image is realized by replacing a head cartridge for black ink with a head cartridge for discharging black photo-ink, magenta photo-ink, and cyanogen photo-ink while keeping higher throughput.

Therefore, when an ink jet recorder is configured so as to mount two head cartridges, a space in the transverse direction parallel with the scanning direction of a carriage is necessary if a transverse-directional-sliding-type fixing method of moving a head cartridge in the direction parallel with the scanning direction of a carriage same as a conventional method is used when setting or removing the head cartridges to or from the ink jet recorder. Thereby, the width of the ink jet recorder is increased and resultantly, increased in size. Therefore, in the case of this embodiment, the direction for moving the head cartridge 10 is orthogonal to the scanning direction of a carriage in order to set the head cartridge 10 to the carriage and correspondingly, the opening 8 and the contact pad 5 are arranged on the back of the head holder 2. Thereby, it is possible to downsize the ink jet recorder and improve the reliability for electrical connection between contact portions.

Moreover, as described above, the exposed portion 4*a* of the flexible cable 4 and the opening 8 are arranged on the back and the same plane of the head holder 2. In this case, if the opening 8 is formed on a plane different from the back of the head holder 8, it is necessary to bend the flexible cable 4 set to the outside of a corner of the head holder 2 by setting a part of the flexible cable 4 to the outside of a corner of the head holder 2 in order to set the contact pad 5 to the back of the head holder 2. In this case, if an impact due to fall of the head cartridge 10 reaches a portion corresponding to the corner of the head cartridge 10, the impact force is directly applied to a flexible cable and thereby, the wiring in the flexible cable may be disconnected. Therefore, even if an impact is applied to the head cartridge 10 because it falls, it is possible to decrease the impact force to the flexible cable 4 by arranging the contact pad 5 of the flexible cable 4 and the opening 8 on the same plane and protect the flexible cable 4 and the wiring of the head cartridge 10.

As shown in FIG. 2, the flexible cable 4 is bent at a plurality of places and set to the head holder 2. A fabrication method of the head cartridge 10 is described later. Though the number of portions of the flexible cable 4 exposed to the outside of the head holder 2 is minimized in the case of this embodiment, the exposed portion 4*a* of the flexible cable 4 may be hung if a finger erroneously contacts the exposed portion 4*a*. Even in this case, it is possible to decrease the impact force to the joint between the flexible cable 4 and the ink jet head 1 by bending the flexible cable 4 in the head holder 2. By bending the flexible cable 4 at a plurality of places, the impact force is further decreased. Moreover, this embodiment is configured so as to directly hold the flexible cable 4 with the inner wall surface of the head holder 2 by bringing the flexible cable 4 into contact with the wall surface. Thereby, it is unnecessary to bond the flexible cable 4 with the head holder 2 and it is possible to keep the flexible cable 4 fixed to the head holder 2. Thus, the reliability against the impact to the head holder 2 is improved.

Moreover, as shown in FIG. 1, the opening 8 is formed at an end of the back of the head holder 2. Therefore, when the opening 8 is formed at the end of the back of the head holder 2, it is possible to increase the area for setting the exposed portion 4*a* of the flexible cable 4 on the back and the area of a plurality of contact pads 5. Therefore, the reliability when the contact pads 5 contact the ink jet recorder is improved. Moreover, because it is possible to expose the flexible cable 4 to any position at the end of the back from the inside of the head holder 2, the versatility of design is also improved. Furthermore, because the opening 8 is present at the end, it is possible to increase the strength of the central portion of the back of the head holder 2, that is, the contact pad 5 of the head holder 2 with the ink jet recorder. Therefore, when bringing the contact pad 5 into contact with the contact pad of the ink jet recorder, the reliability of electrical connection between contact pads is improved. As a result, the reliability when the head cartridge 10 contacts the ink jet recorder is improved.

Figure 4:
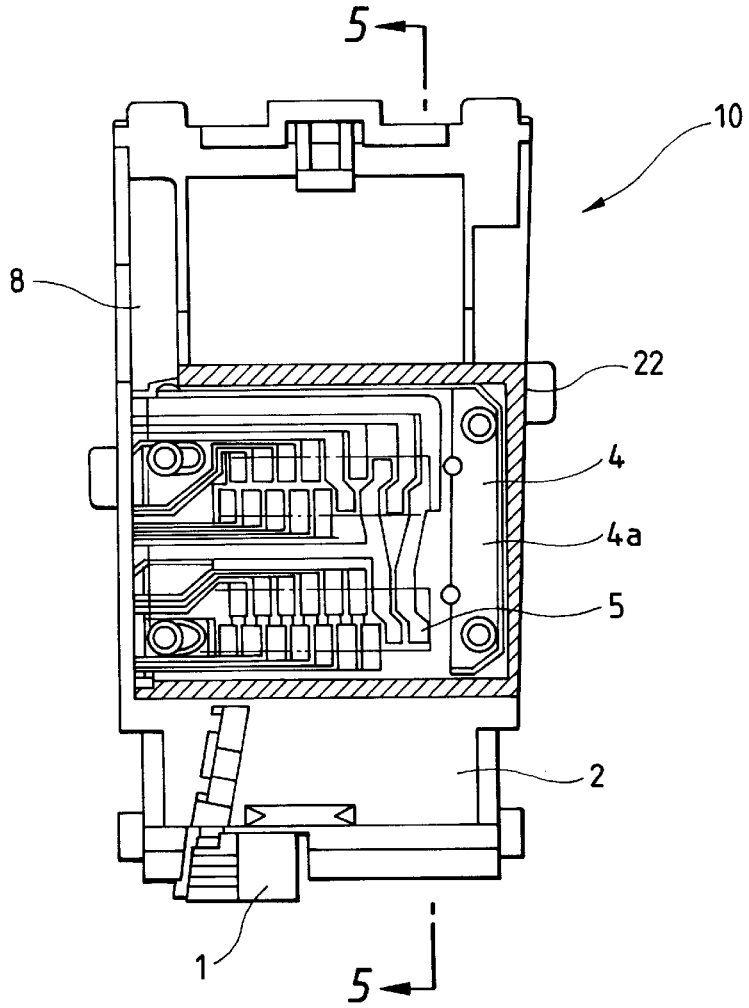
FIG. 4 is a top view of the head cartridge in FIG. 1 viewed from the opening side.
Figure 5:
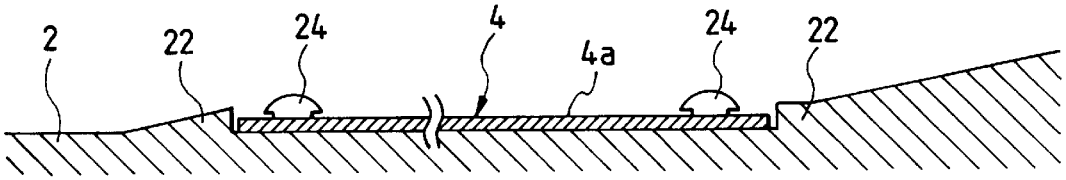
FIG. 5 is a sectional view taken along the line 5—5 in FIG. 4.

FIG. 4 is a top view of the head cartridge 10 shown in FIG. 1, viewed from the opening-8 side. FIG. 5 is a sectional view taken along the line 5—5 in FIG. 4. As shown in FIG. 4, a bank 22 is formed around the exposed portion 4*a* of the flexible cable 4 of the head holder 2 as a stepped portion protruded from a plane to which the exposed portion 4*a* of the head holder 2 is fixed. In FIG. 4, the bank 22 is hatched. In this case, the exposed portion 4*a* is almost rectangular and the bank 22 is formed outside of three sides of the exposed portion 4*a* excluding the side of the portion 4*a* at the opening 8. As shown in FIG. 5, the flexible cable 4 is fixed to the head holder 2 by a caulking dowel 24 and the bank 22 is higher than the upside of the exposed portion 4, that is, the plane of the exposed portion 4 at the contact pad-5 side compared to the setting plane of the exposed portion 4*a*, in order to prevent hang-up such as contact of a finger with the exposed portion 4*a* of the flexible cable 4 and protect the exposed portion 4*a*.

In the case of this embodiment, the bank 22 having a slope is formed around the exposed portion 4*a* of the flexible cable 4 as shown in FIG. 5. In addition to the above configuration, the same advantage is also obtained by forming a concave portion deeper than the thickness of the flexible cable 4 on the setting plane of the exposed portion 4*a* of the head holder 2 and form a bank around the exposed portion 4*a* or forming a rib higher than the thickness of the flexible cable 4 around the exposed portion 4*a*. Thus, by forming a bank around the exposed portion 4*a* of the flexible cable 4, it is possible to further improve the reliability for protecting the flexible cable 4.

Moreover, a plurality of louvers 11 for communicating the inside and outside of the head holder 2 each other is formed at a portion of the head holder nearby the joint between the ink jet head 1 and flexible cable 4 of the head holder 2. By forming the louvers 11 on the head holder 2, discharging ink from an ink discharge port 3, and thereby performing recording, the heat in the head holder 2 is discharged to the outside of the head holder 2 through the louvers 11 even if the temperature of the ink jet head 1 rises. Thereby, the flexible cable 4 and ink jet head 1 are cooled and deformation of the flexible cable 4 or a trouble of the joint between the flexible cable 4 and ink jet head 1 is prevented. As shown in FIG. 2, by forming the louvers 11 at the both side faces of the head holder 2 in the head operating direction, the air-cooling effect for the ink jet head 1 and flexible cable 4 increases corresponding to the movement of the head cartridge 10 during recording and the louvers 11 become more effective as cooling means.

Then, a method for manufacturing the head assembly 6 shown in FIG. 1 is described below.

First, the flexible cable 4, ink jet head 1, and head holder 2 are fabricated as shown in FIGS. 1 and 2.

Figure 6B:
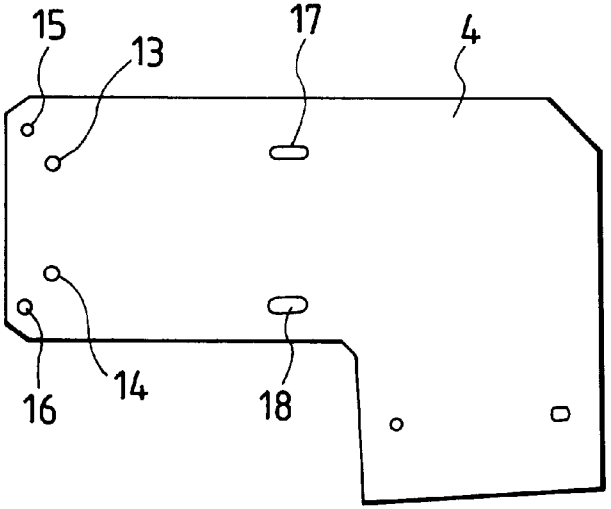
FIGS. 6A and 6B are top views for explaining the flexible cable shown in FIGS. 1 and 2.
Figure 6A:
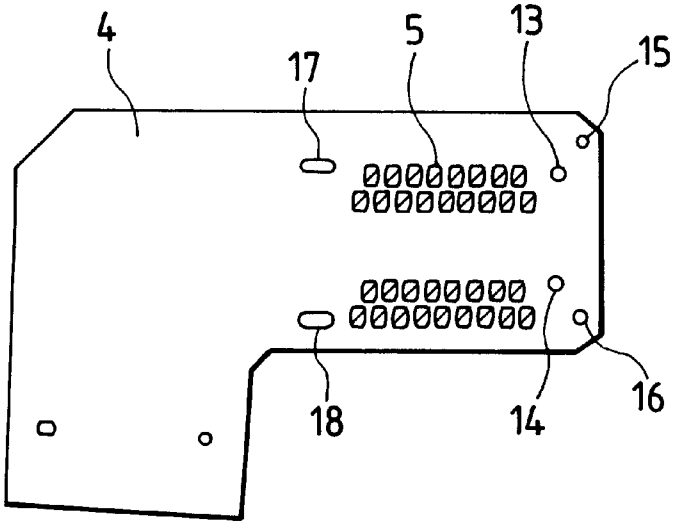

FIGS. 6A and 6B are top views for explaining the flexible cable 4. FIG. 6A is a top view of the surface of the flexible cable 4, that is, a top view of the plane at the contact pad-5 side and FIG. 6B is a top view of the back of the flexible cable 4. The flexible cable 4 shown in FIGS. 6A and 6B shows a state before the flexible cable 4 is bent to set it to the head holder 2 as described later.

As shown in FIG. 6A, a plurality of contact pads 5 are formed at an end of the flexible cable 4. As shown in FIGS. 6A and 6B, completely-circular holes 13 and 14 for positioning the flexible cable 4 to the head holder 2 and completely-circular holes 15 and 16 and slots 17 and 18 for fixing the flexible cable 4 to the head holder 2 through welding are formed nearby the contact pad 5 of the flexible cable 4. As described later, when setting the flexible cable 4 to the head holder 2, a welding pin formed on the head holder 2 passes through the completely-circular holes 15 and 16 and slots 17 and 18.

Figure 7:
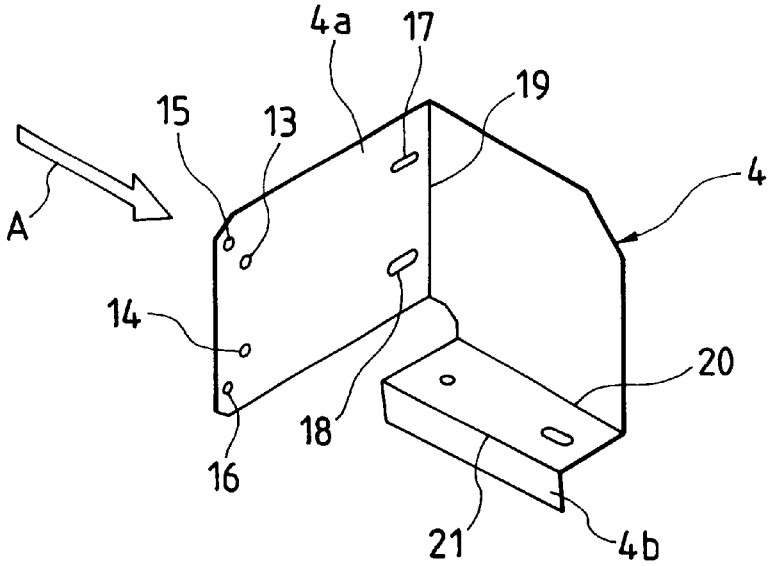
FIG. 7 is an illustration for explaining the step of bending the flexible cable shown in FIG. 6.

FIG. 7 is an illustration for explaining the step of bending the flexible cable 4 shown in FIGS. 6A and 6B. As shown in FIG. 7, bent portions 19, 20, and 21 are formed on the flexible cable 4 by bending the flexible cable 4 at three places of the flexible cable 4 correspondingly to the inside shape of the head holder 2 to form creases. The portion closer to the slots 17 and 18 than to the bent portion 19 serves as the above-described exposed portion 4*a*. The plane of the exposed portion 4*a* viewed from the direction of the arrow A in FIG. 7 serves as the contact plane with the ink jet recorder.

The bent portions 19 and 20 become a convexly-bent state to the plane of the flexible cable 4 at the contact pad-5 side and the bent portion 21 becomes a concavely-bent state to the plane of the flexible cable 4 at the contact pad-5 side. Unless the creases are previously formed on the flexible cable 4, it is impossible to fix the flexible cable 4 to the head holder 2 without using an adhesive. For example, unless the creases are formed, the flexible cable 4 does not become a predetermined shape corresponding to the shape of the head holder 2. Therefore, as described later, the fabrication step of fixing an assembly configured by joining the flexible cable 4 with the ink jet head 1 to the head holder 2 becomes complex. Moreover, it is necessary to bond the flexible cable 4 to the head holder 2 in order to keep the flexible cable 4 in a predetermined shape when setting the flexible cable 4 to the head holder 2. For example, even if the flexible cable 4 is bonded, the bonded portion between the flexible cable 4 and the head holder 2 may come off because a force for returning to the original shape is generated in the flexible cable 4. As a result, the joint between the flexible cable 4 and the ink jet head 1 may come off.

Therefore, by forming creases on the flexible cable 4 and thereby forming the bent portions 19, 20, and 21, the flexible cable 4 can be fixed to the head holder 2 at a high reliability without using bonding.

Portions of the flexible cable 4 other than the exposed portion 4*a* are arranged inside of the head holder 2 when setting the flexible cable 4 to the head holder 2. In this case, the portion between the bent portions 19 and 20 of the flexible cable 4 contacts the inner wall of the head holder 2. The portion of the bent portion 21 of the flexible cable 4 at the side opposite to the bent portion 20 serves as a joint 4*b* to be jointed with the ink jet head 1.

Figure 8:
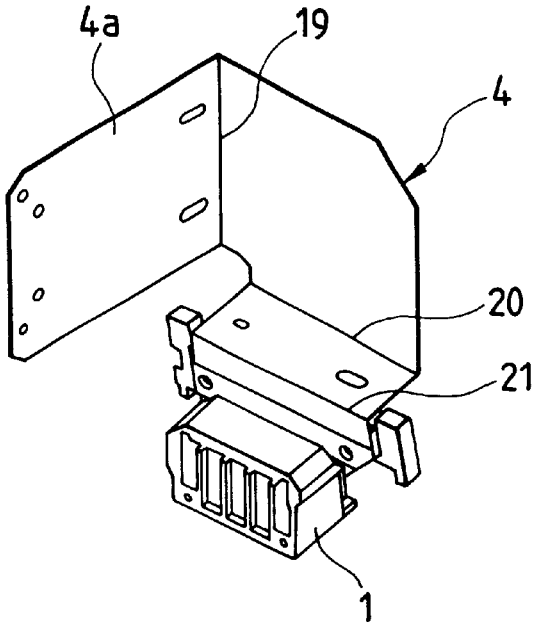
FIG. 8 is a perspective view showing a state of joining the bent flexible cable shown in FIG. 7 with an ink jet head.

FIG. 8 is a perspective view showing a state in which the flexible cable 4 is bent as shown in FIG. 7 and thereafter, the flexible cable 4 is jointed with the ink jet head 1. As shown in FIG. 8, after only the flexible cable 4 is bent, the ink jet head 1 previously fabricated in another process is jointed to the joint 4*b* of the flexible cable 4 by solder or the like. Thereby, the flexible cable 4 is electrically connected with the ink jet head 1. The ink jet head 1 is fabricated in the main line among the fabrication lines for manufacturing an ink jet recorder. To join the ink jet head 1 with the flexible cable 4, it is necessary to align the contact pad of the ink jet head 1 and that of the flexible cable 4. Though it is the main object to electrically connect the wiring in the ink jet head 1 with the wiring in the flexible cable 4, the joint between the ink jet head 1 and the flexible cable 4 mechanically requires a certain-degree adhesive strength, in order to prevent the joint from being removed when handing an assembly configured by joining the ink jet head 1 with the flexible cable 4 in a fabrication line. Moreover, to prevent the electrolytic corrosion of the joint between the ink jet head 1 and the flexible cable 4, it is permitted to isolate the joint from outside air by sealing the joint with a sealant or the like.

Figure 9:
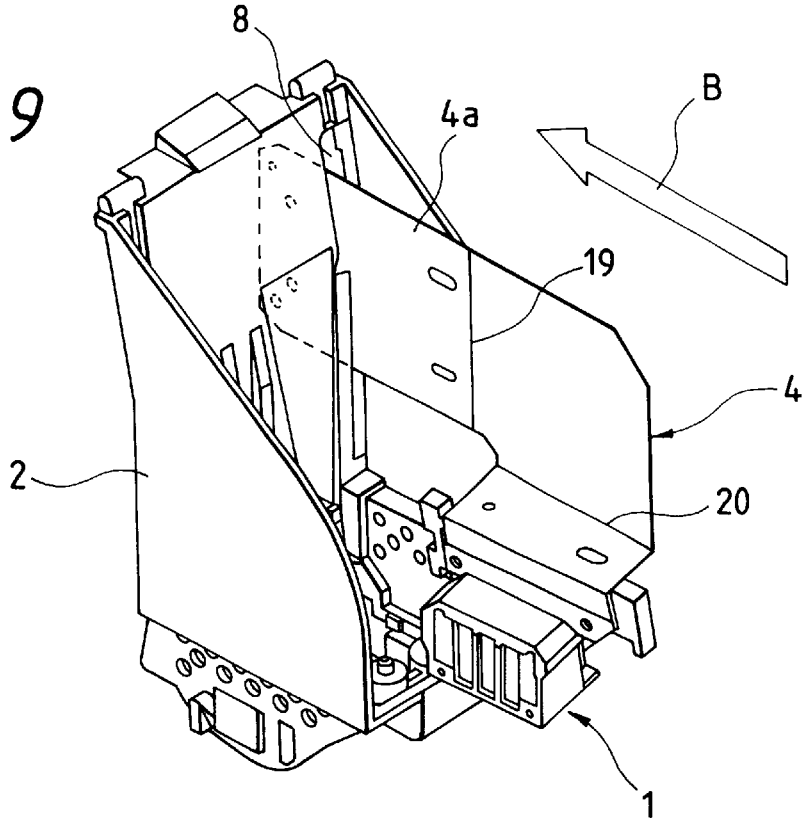
FIG. 9 is a perspective view for explaining the step of setting an assembly obtained by joining a flexible cable with an ink jet head to a head holder.
Figure 10:
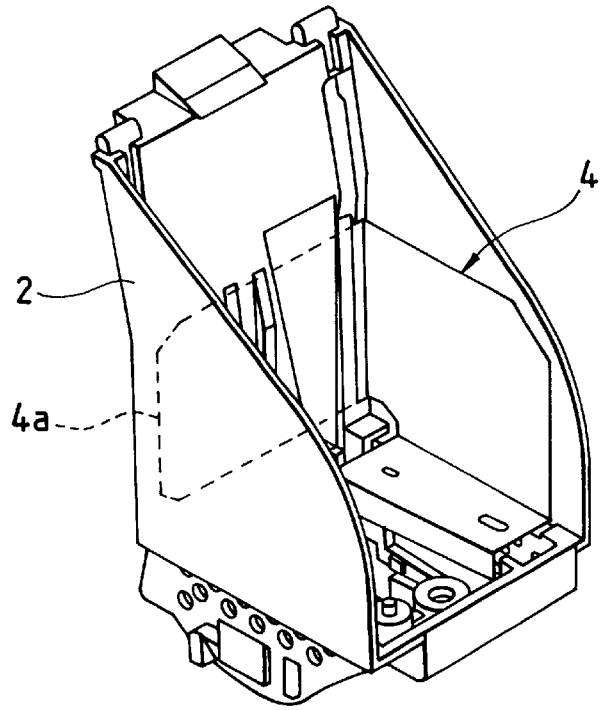
FIG. 10 is a perspective view for explaining the step of an assembly obtained by joining a flexible cable with an ink jet head to a head holder.

FIGS. 9 and 10 are perspective views for explaining the step of setting an assembly configured by joining the flexible cable 4 with the ink jet head 1 to the head holder 2. When fixing the assembly configured by joining the flexible cable 4 with the ink jet head 1 to the head holder 2, the ink jet head 1 is first slid in the sliding direction shown by the arrow B in FIG. 9 and the ink jet head 1 is moved above a position nearby the position for finally fixing the ink jet head 1. In this case, the exposed portion 4*a* of the flexible cable 4 is returned from the temporarily-bent state and expanded and the exposed portion 4*a* is inserted into the opening 8 from the inside of the head holder 2 to pass the exposed portion 4*a* through the opening 8. Thereby, the exposed portion 4*a* is brought to the outside of the head holder 2 through the opening 8. Therefore, the length of the opening 8 is made larger than the width of the exposed portion 4*a* so that the exposed portion 4*a* can be inserted into the opening 8 without contacting the head holder 2 when setting the flexible cable 4 to the head holder 2 by almost horizontally moving the flexible cable 4 bent into almost L-shape. Even if the flexible cable 4 is returned and expanded, creases on the flexible cable 4 are not removed for a short time. However, when the force for expanding the exposed portion 4*a* is removed, the flexible cable 4 returns to the almost original state shown in FIGS. 7 and 8.

Then, the ink jet head 1 and the flexible cable 4 are lowered, the ink jet head 1 is dashed against the bottom end in the head holder 2 as shown in FIG. 10, and at the same time, the ink jet head 1 and flexible cable 4 are moved to the side opposite to the contact pad 5 side to dash the ink jet head 1 against a part of the head holder 2. In this case, the ink jet head 1 and head holder 2 are configured so that the ink jet head 1 can be set in the head holder 2 by press-fitting the ink jet head 1 into the head holder 2 and thereby positioning the ink jet head 1 in the head holder 2. Therefore, by press-fitting the ink jet head 1 into the head holder 2, the position of the ink jet head 1 to the head holder 2 is determined. Thereafter, by boding the ink jet head 1 to the head holder 2, the ink jet head 1 is completely fixed to the head holder 2 and thus, the ink jet head 1 becomes immovable to the head holder 2.

Figure 11:
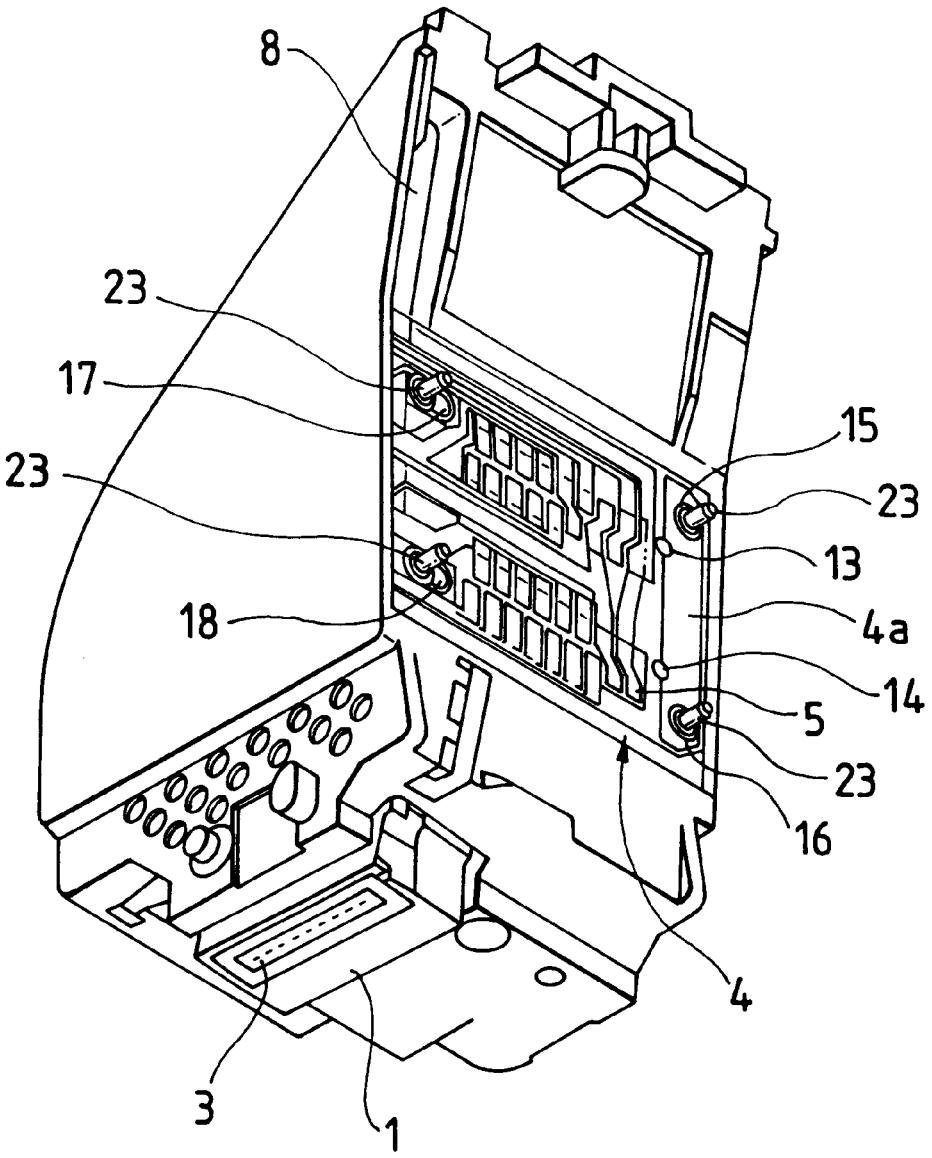
FIG. 11 is a perspective view for explaining the step of fixing the exposed portion of a flexible cable to a head holder.

Then, a method for fixing the exposed portion 4*a* to the head holder 2 is described below. FIG. 11 is a perspective view for explaining the step of fixing the exposed portion 4*a* of the flexible cable 4 to the head holder 2. Four caulking pins 23 protruding from the setting plane of the exposed portion 4*a* in the head holder 2 are formed on the setting plane as shown in FIG. 11. Each caulking pin 23 corresponds to each of the completely-circular holes 15 and 16 and slots 17 and 18 of the flexible cable 4, respectively.

First, a guide pin of an assembling unit is inserted into the completely-circular holes 13 and 14 for positioning the flexible cable 4 to guide the exposed portion 4*a* by the guide pins. By guiding the exposed portion 4*a* in the above manner, the exposed portion 4*a* is positioned to the head holder 2 so as to pass the respectively-corresponding caulking pin 23 through each of the completely-circular holes 15 and 16 and slots 17 and 18. Then, by melting the caulking pin 23 passing through the completely-circular hole 15 and the caulking pin 23 passing through the completely-circular hole 16, portions around the completely-circular holes 15 and 16 of the exposed portion 4*a* are welded to the head holder 2 to determine the position of the contact pad 5. Thereafter, by melting the caulking pins 23 of the slots 17 and 18 while keeping the flexible cable 4 tense and portions around the slots 17 and 18 of the exposed portion 4*a* are welded to the head holder 2 to finally fix the flexible cable 4 to the head holder 2. The flexible cable 4 may be fixed to the head holder 2 through a flat member located between the flexible cable 4 and the head holder 2 to maintain the flatness.

When performing welding by using the caulking pin 23, it is permitted to use either of the thermal welding method and the ultrasonic welding method. According to either of the above methods, it is possible to fabricate a head assembly 6 configured by setting the ink jet head 1 and flexible cable 4 to the head holder 2. Moreover, by setting a tank holder 9 to the head holder 2, the head cartridge 10 shown in FIG. 1 is finally obtained.

Each of the above-described fabrication methods makes it possible to easily fabricate the head assembly 6 and head cartridge 10 capable of improving the reliability and lengthening the service life.

As another embodiment of the present invention, an example is described below in which a flexible wiring board is fixed by a hot-melt sheet using polyester and/or polyolefin as a base polymer.

As the base polymer made of a polyester-based hot-melt material for this embodiment, a copolymerized filamentary polymer is synthesized by polycondensing dibasic acid and dihydric glycol or oxy acid at a high temperature and a high pressure. By selecting the material monomer, it is possible to freely synthesize materials ranging from a highly-crystalline strong polymer to an amorphous soft polymer. Typical dibasic acids are terephthalic acid, isophthalic acid, succinic acid, sebasic acid, and dodecanoic diacid. Moreover, typical glycols are ethylene glycol, propylene glycol, 1,4-butanediol, 1,6-hexanediol, cyclohexanediol, polyoxyethylene glycol, polyoxypropylene glycol, and polyoxybutylene glycol or the like. Preferred examples are 615EG film (thickness of 62.5 $\mu$m) market-available from 3M Corporation and D3600 (thickness of 50 $\mu$m) market-available from Sony Chemicals Corporation.

Base polymers made of polyolefin-based hot-melt materials for this embodiment are atactic polypropylene, low-density polyethylene, and amorphous poly-alpha olefin. It is permitted to add a tacky resin, petroleum-base wax, and antioxidant to these base polymers by a predetermined quantity. A preferred example is D3300 (thickness of 60 $\mu$m) market-available from Sony Chemicals Corporation.

The above FPC assembly is bonded to a structural member by a polyester-based or polyolefin-based hot-melt sheet. In this case, it is possible to properly use the pressing or laminating method at a temperature of 100 to 180° C. and a pressure of 0.5 to 30 kg/cm$^2$. Polyester- and polyolefin-based polymers are superior in alkali resistance compared to EVA and EAA and moreover, superior in adhesive strength at a high temperature though the polymer are thermoplastic resins. Therefore, the polymers improve the reliability of an ink jet head.

Figure 12:
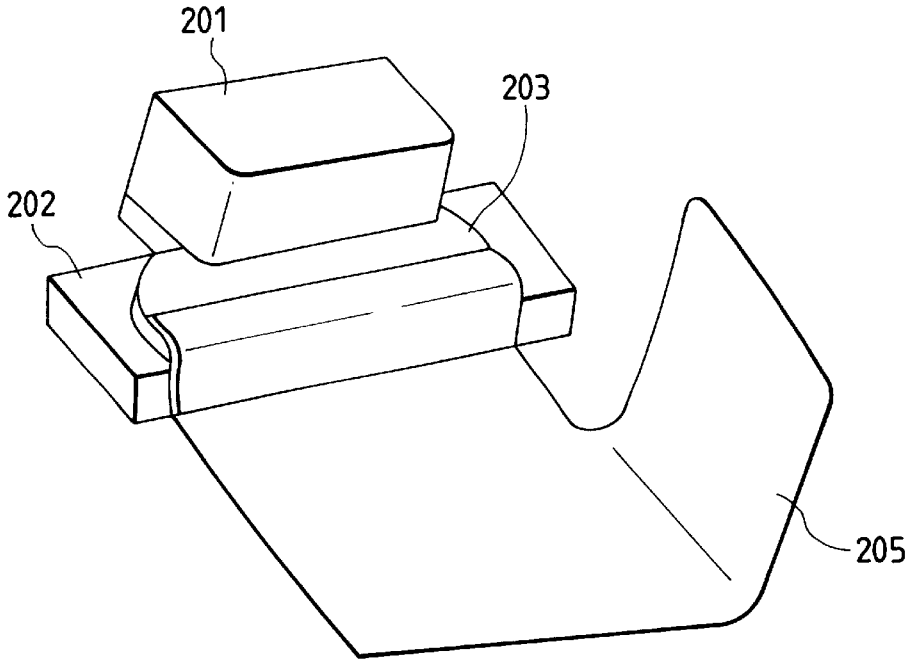
FIG. 12 is a schematic perspective view showing the ink jet head unit of another embodiment of the present invention.

FIG. 12 is a schematic perspective view showing the ink jet head unit of another embodiment of the present invention. As shown in FIG. 12, a board in which a heater and a driver are fabricated through a general-purpose silicon process is die-bonded to an aluminum base plate 202 pasted with a printed wiring board (PWB) 203. Then, a top plate 201 on which a discharge port is formed by an excimer laser is pasted to a resin top plate made of polysulfone on which an ink channel, a liquid chamber, and a nozzle are formed through injection molding while positioning the discharge port and the heater so that they are most preferably fitted each other and thereafter, fixed by a spring to obtain a spring assembly. A flexible printed circuit (FPC) 205 is joined to the spring assembly to obtain a head unit.

Figure 13:
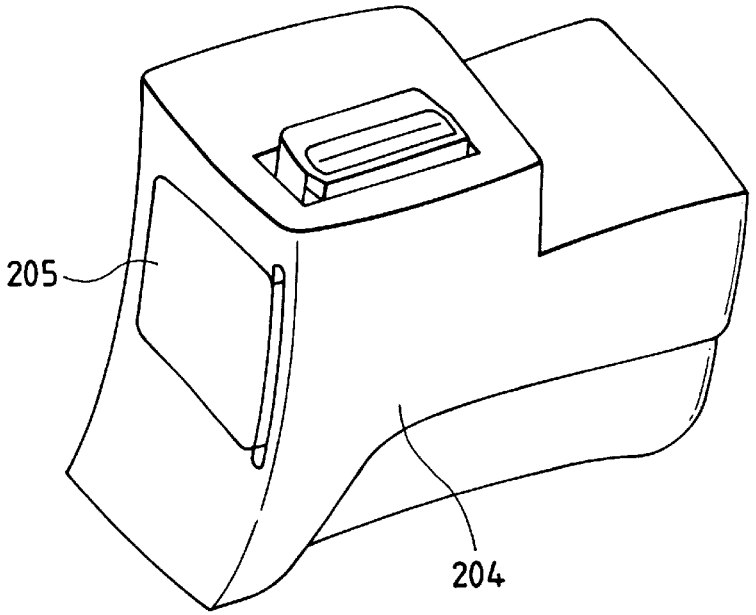
FIG. 13 is a schematic perspective view showing the head cartridge of another embodiment of the present invention.

FIG. 13 is a perspective view showing the head cartridge of another embodiment of the present invention.

EXAMPLE 1

A head unit was built in an ink-jet-head structural member 204 so that a portion on which the contact portion of a flexible cable was formed was exposed to the outside of a head holder from the opening of the head holder similarly to the case of the embodiment described by referring to FIG. 1 and the like and bonded by a polyester-based hot-melt sheet 615EG (made by 3M Corporation). In this case, the adhesive strength between an FPC and the structural member was 2.5 kg/cm$^2$.

EXAMPLE 2

Similarly to example 1, a head unit was built in an ink-jet-head structural member and bonded by a polyolefin-based hot-melt sheet D3300 (made by Sony Chemicals Corporation). In this case, the adhesive strength between an FPC and the structural member was 2.4 kg/cm$^2$.

EXAMPLE 3

Similarly to example 1, a head unit was built in an ink-jet-head structural member and bonded by an EVA-based hot-melt sheet 557EG (made by 3M Corporation). In this case, the adhesive strength between an FPC and the structural member was 2.5 kg/cm$^2$.

[Resistance Evaluation]

To evaluate alkaline ink resistance, the ink jet head units obtained through examples 1 to 3 were put in the atmosphere of alkaline ink vapor at 60° C. The pH of the alkaline ink was 10.

Though the adhesive strength one week after putting the example 1 in the atmosphere was 1.0 kg/cm$^2$ as for the example 3, a higher adhesive strength of 1.8 kg/cm$^2$ was shown as for the examples 1 and 2 respectively. As the result of continuing evaluation, no positional shift or separation was found on the examples 1 and 2 even after three months.

It is needless to say that combining the above embodiments each other is included in the category of the present invention.

Figure 14:
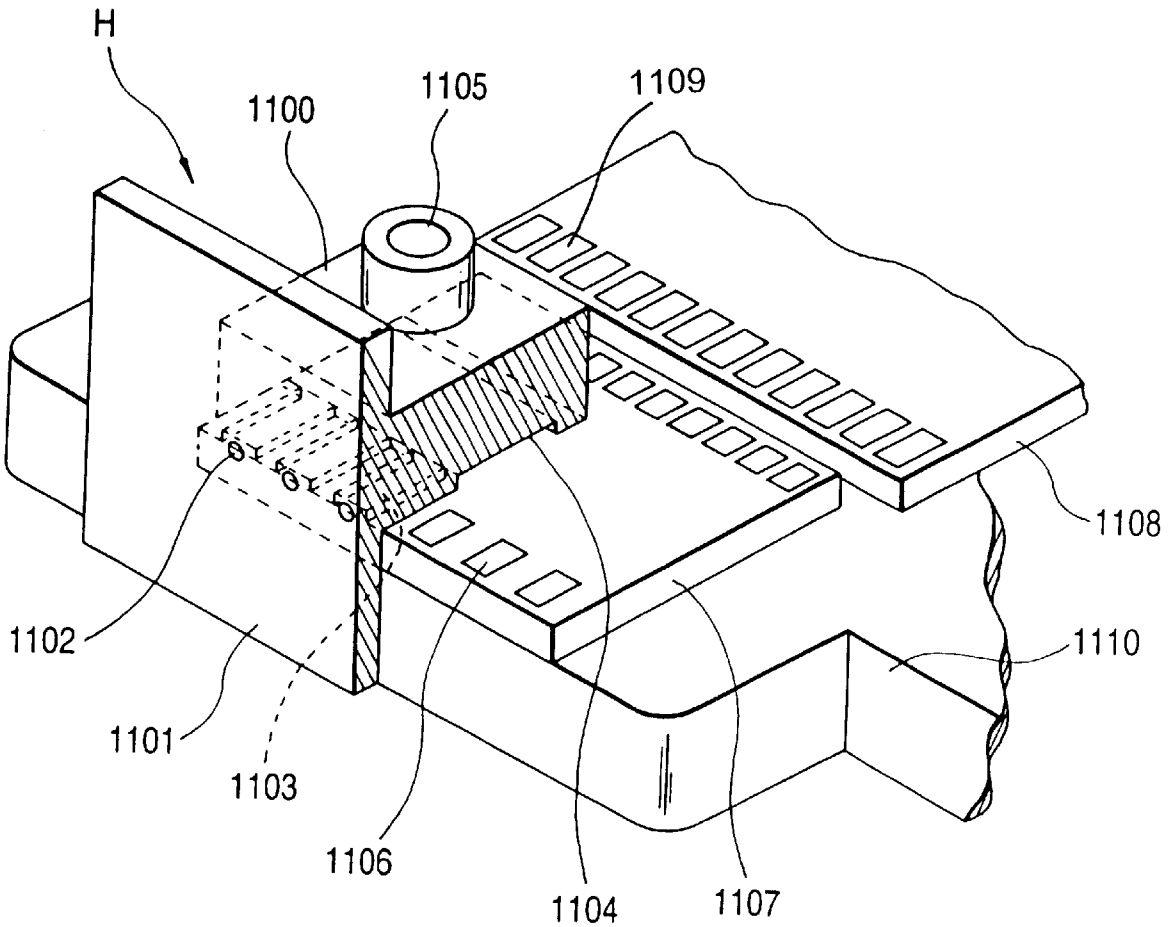
FIG. 14 is a schematic perspective view showing an essential portion of an ink jet head to be incorporated into the head cartridge of an embodiment of the present invention.

A general configuration of the above-described ink-jet recording head is described below by referring to FIG. 14.

A top plate 1100 constituting an ink jet recording head H is made of a resin, on which a top-plate member for forming a liquid chamber 1104 for storing a recording liquid and a plurality of liquid channels 1103, a discharge-port forming member 1101 for forming a plurality of discharge ports (orifices) 1102 communicating with the liquid channels 1103, and a recording-liquid supply port 1105 are integrally formed. Moreover, a plurality of heaters (electrothermal bodies) 1106 arranged on a silicon board and not-illustrated electrical wiring made of aluminum or the like for supplying power to the heaters 1106 are formed on a heater board (element board) 1107 by the publicly-known film formation technique and positioned and fixed onto a base plate 1110 by the publicly-known die-bonding technique. A wiring board 1108 has a wiring connected by the publicly-known wire-bonding correspondingly to the wiring of the heater board 1107 and a plurality of pads 1109 located at an end of the wiring to receive an electric signal from a recorder. Moreover, the top plate 1100 and the heater board 1107 are positioned and joined each other so as to correspond to the liquid channel 1103 and heater 1106, fixed onto the base plate 1110 together with the wiring board 1108 to form the ink jet recording head H.

Figure 15:
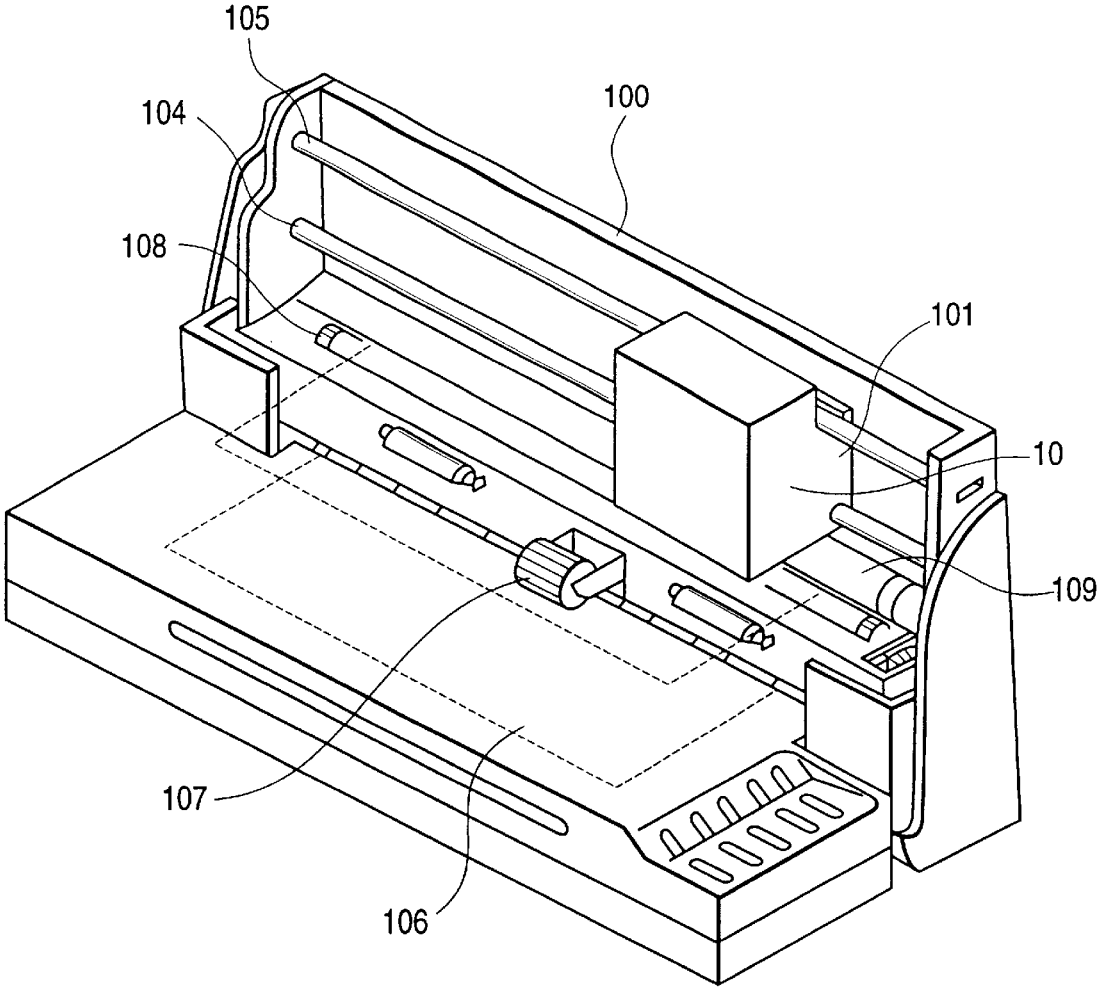
FIG. 15 is a perspective view showing an ink jet recorder mounting the head cartridge of an embodiment of the present invention.

FIG. 15 is a perspective view showing an ink jet recorder mounting the head cartridge 10 shown in FIG. 1. In the case of the ink jet recorder shown in FIG. 15, a lead screw 104 and a guide shaft 105 parallel with each other are provided for the frame. A carriage 101 is set to the lead screw 104 and guide shaft 105 so as to be movable in the direction parallel with the lead screw 104 and guide shaft 105. The carriage 101 is translated when the lead screw 104 is rotated by a carriage motor (not illustrated).

The head cartridge 10 provided with the ink jet head 1 shown in FIG. 1 is mounted on the carriage 101. A sheet holding plate 109 is set nearby the moving-trace plane of the discharge plane of the ink jet head 1.

Moreover, the ink jet recorder is provided with a sheet feed roller 107 for carrying a recording sheet 106 serving as a recording medium toward the recording area of the ink jet head 1 and a sheet ejection roller 108 for ejecting the recording sheet 106 in which data is recorded by the ink jet head 1. The sheet feed roller 107 and sheet ejection roller 108 are rotated by a not-illustrated motor. A recording-medium carrying system for carrying the recording sheet 106 for receiving the liquid discharged from the ink jet head 1 of the head cartridge 10 is configured of the motor, sheet feed roller 107, and sheet ejection roller 108. Moreover, the carriage 101 reciprocates in the direction intersecting with the carrying direction of the recording sheet 106 by the recording-medium carrying system.

The ink discharged from the ink jet head 1 attaches to the recording sheet 106 facing the discharge-port face of the ink jet head 1 and thereby, a recorded image is formed on the surface of the recording sheet 106. The recording sheet 106 is ejected to the outside of the ink jet recorder by the sheet feed roller 107 and sheet ejection roller 108 rotated by a motor and the sheet holding plate 109 interlocking with recording of data in the recording sheet 106 by the ink jet head 1.

What is claimed is:

1. A head holder comprising:

an ink jet head for discharging ink; and a flexible cable having a contact portion to which an electric signal for discharging ink from the ink jet head is transferred, the flexible cable being joined to the ink jet head;

wherein an opening through which the flexible cable passes is formed in the head holder and a portion of the flexible cable on which the contact portion is formed passes through the opening and is exposed to the outside of the head holder.

2. The head holder according to claim 1, wherein the opening of the head holder and the exposed portion of the flexible cable are arranged on the same plane of the head holder.

3. The head holder according to claim 1, wherein:

a head assembly configured by setting the ink jet head and the flexible cable to the head holder is set to a carriage provided for an ink jet recorder for recording data in a recording medium; and the opening of the head holder and the exposed portion of the flexible cable are arranged on a plane facing the carriage side when the head holder is set to the carriage.

4. The head holder according to claim 1, wherein:

the flexible cable has at least one bent portion correspondingly to the inside shape of the head holder; and the length of the opening of the head holder is larger than the width of the exposed portion of the flexible cable having the bent portion so that the exposed portion can be inserted into the opening from the inside of the head holder when the flexible cable is set to the head holder.

5. The head holder according to claim 1, wherein the opening of the head holder is formed at an end of the plane of the head holder in which the opening of the head holder is formed.

6. The head holder according to claim 1, wherein:

the exposed portion of the flexible cable serves as a portion to be fixed to the head holder; and a stepped portion protruding from the plane of the head holder to which the exposed portion is fixed is formed on a portion serving as the circumferential portion of the exposed portion.

7. The head holder according to claim 1, wherein a hole for communicating the inside and outside of the head holder with each other is formed on a portion of the head holder nearby the joint between the ink jet head and the flexible cable.

8. The head holder according to claim 1, wherein the flexible cable is joined to the head holder by a hot-melt sheet using polyester as a base polymer.

9. The head holder according to claim 1, wherein the flexible cable is joined to the head holder by a hot-melt sheet using polyolefin as a base polymer.

10. The head holder according to claim 1, wherein the flexible cable is joined to the head holder by caulking with thermal welding.

11. The head holder according to claim 1, wherein the flexible cable is joined to the head holder by caulking with ultrasonic welding.

12. A head assembly comprising:

an ink jet head for discharging ink;

a flexible cable having a contact portion to which an electric signal for discharging ink from the ink jet head is transferred, the flexible cable being joined to the ink jet head; and a head holder to which the ink jet head and the flexible cable are set;

wherein an opening through which the flexible cable passes is formed on the head holder and the portion of the flexible cable on which the contact portion is formed passes through the opening and is exposed to the outside of the head holder.

13. The head assembly according to claim 12, wherein the opening of the head holder and the exposed portion of the flexible cable are arranged on the same plane of the head holder.

14. The head assembly according to claim 12, wherein:

the head assembly is set to a carriage provided for an ink jet recorder for recording data in a recording medium; and the opening of the head holder and the exposed portion of the flexible cable are arranged on the plane facing the carriage side when setting the head holder to the carriage.

15. The head assembly according to claim 12, wherein the opening of the head holder is formed at an end of the plane of the head holder on which the opening is formed.

16. The head assembly according to claim 12, wherein the flexible cable has at least one bent portion correspondingly to the inside shape of the head holder.

17. The head assembly according to claim 16, wherein the length of the opening of the head holder is larger than the width of the exposed portion of the flexible cable having the bent portion so that the exposed portion can be inserted into the opening from the inside of the head holder when setting the flexible cable to the head holder.

18. The head assembly according to claim 12, wherein:

the exposed portion of the flexible cable is fixed to the head holder; and a stepped portion of the head holder protruding from the plane of the head holder to which the exposed portion of the flexible cable is fixed is formed at a portion around the exposed portion.

19. The head assembly according to claim 12, wherein a hole for communicating the inside and outside of the head holder with each other is formed at a portion of the head holder nearby the joint between the ink jet head and the flexible cable.

20. The head assembly according to claim 12, wherein the flexible cable is joined to the head holder by a hot-melt sheet using polyester as a base polymer.

21. The head assembly according to claim 12, wherein the flexible cable is joined to the head holder by a hot-melt sheet using polyolefin as a base polymer.

22. The head assembly according to claim 12, wherein the ink jet head is provided with an electrothermal body for generating the energy used to discharge ink.

23. The head assembly according to claim 22, wherein the ink jet head discharges ink by using the film boiling produced in ink due to the thermal energy applied from the electrothermal body.

24. A head cartridge comprising the head assembly according to claim 12 and an ink storing vessel removably set to the head holder of the head assembly to store the ink to be supplied to the ink jet head.

25. An ink jet recorder comprising the head cartridge according to claim 24 and a recording-medium carrying system for carrying a recording medium for receiving the ink discharged form the ink jet head of the head cartridge.

26. The head assembly according to claim 12, wherein the flexible cable is joined to the head holder by caulking with thermal welding.

27. The head assembly according to claim 12, wherein the flexible cable is joined to the head holder by caulking with ultrasonic welding.

28. An ink jet recorder comprising:

an ink jet head for discharging ink;

a flexible cable having a contact portion to which an electric signal for discharging ink from the ink jet head is transferred, the flexible cable being joined to the ink jet head;

a head holder to which the ink jet head and the flexible cable are set;

a head cartridge configured by setting the ink jet head and the flexible cable to the head holder;

a recording-medium carrying system for carrying a recording medium for receiving the ink discharged from the ink jet head of the head cartridge; and a carriage to be reciprocated in the direction intersecting with the carrying direction of the recording medium by mounting the head cartridge;

wherein an opening through which the flexible cable passes is formed on the head holder and the portion of the flexible cable on which the contact portion is formed passes through the opening and is exposed to the outside of the head holder.

29. The ink jet recorder according to claim 28, wherein the opening of the head holder and the exposed portion of the flexible cable are arranged on the same plane of the head holder.

30. The ink jet recorder according to claim 28, wherein:

the head assembly is set to the carriage provided for the ink jet recorder for recording data in a recording medium; and the opening of the head holder and the exposed portion of the flexible cable are arranged on the plane facing the carriage side when setting the holder to the carriage.

31. The ink jet recorder according to claim 28, wherein the opening of the head holder is formed at an end of the plane of the head holder on which the opening is formed.

32. The ink jet recorder according to claim 28, wherein the flexible cable has at least one bent portion correspondingly to the inside shape of the head holder.

33. The ink jet recorder according to claim 32, wherein the length of the opening of the head holder is larger than the width of the exposed portion of the flexible cable having the bent portion so that the exposed portion can be inserted into the opening from the inside of the head holder when setting the flexible cable to the head holder.

34. The ink jet recorder according to claim 28, wherein:

the exposed portion of the flexible cable is fixed to the head holder; and a stepped portion protruding from the plane of the head holder to which the exposed portion is fixed is formed at the portion around the exposed portion.

35. The ink jet recorder according to claim 28, wherein a hole for communicating the inside and outside of the head holder with each other is formed at a portion of the head holder nearby the joint between the ink jet head and the flexible cable.

* * * * *

UNITED STATES PATENT AND TRADEMARK OFFICE

CERTIFICATE OF CORRECTION

PATENT NO. : 6,305,785 B1
DATED : October 23, 2001
INVENTOR(S) : Ken Hosaka et al.

It is certified that error appears in the above-identified patent and that said Letters Patent is hereby corrected as shown below:

Title page,
Item [56], References Cited, U.S. PATENT DOCUMENTS, insert
-- 5,182,581 1/1993 Kashimura et al. ..... 347/87 --; and insert -- FOREIGN PATENT DOCUMENTS
488829 6/1992 European Pat. Off.
791466 8/1997 European Pat. Off.
730966 9/1996 European Pat. Off.
802056 10/1997 European Pat. Off. --.

Column 2,
Line 4, "be" should be deleted.

Column 5,
Line 29, "due" should read -- due to --.

Column 11,
Line 21, "boding" should read -- bonding --.

Column 12,
Line 57, "formed" should read -- formed, --.

Column 16,
Line 15, "form" should read -- from --.

Signed and Sealed this

Twenty-second Day of April, 2003

JAMES E. ROGAN
*Director of the United States Patent and Trademark Office*